US005192379A

United States Patent [19]

Johnson et al.

[11] Patent Number: 5,192,379

[45] Date of Patent: Mar. 9, 1993

[54] DENSIFYING AND STABILIZING INGREDIENT

[75] Inventors: Craig E. Johnson, Indian Head; Paul F. Dendor, Oxon Hill, both of Md.

[73] Assignee: The United States of America as represented by the Secretary of the Navy, Washington, D.C.

[21] Appl. No.: 521,977

[22] Filed: Nov. 6, 1974

[51] Int. Cl.[5] ..... C06B 45/10

[52] U.S. Cl. ..... 149/19.4; 149/19.8; 149/38; 149/44; 149/96; 149/100; 149/19.1

[58] Field of Search ..... 149/19.8, 76, 38, 42, 149/44, 92, 19.4, 96, 100, 19.1

[56] References Cited

U.S. PATENT DOCUMENTS

| | | | |
|---|---|---|---|
| 3,734,788 | 5/1973 | Kaufman | 149/19.3 |
| 3,753,811 | 8/1973 | Julian et al. | 149/19.3 |
| 3,785,888 | 1/1974 | Shaver et al. | 149/38 |
| 3,791,893 | 2/1974 | Hill | 149/38 |
| 4,017,342 | 4/1977 | Geisler et al. | 149/5 |
| 4,876,477 | 4/1975 | Eldridge et al. | 149/19.3 |

*Primary Examiner*—Edward A. Miller
*Attorney, Agent, or Firm*—Kenneth E. Walden

[57] ABSTRACT

Lead fluoride acts as a densifying and stabilizing ingredient for a propellant.

13 Claims, No Drawings

DENSIFYING AND STABILIZING INGREDIENT

BACKGROUND OF THE INVENTION

This invention relates to explosives and more particularly to that branch of explosives known as propellants wherein the propellants are those stabilized and densified with at least one lead fluoride.

In the explosive field there are four general subdivisions -(1) primary explosives (2) secondary explosives, (3) pyrotechnics, and (4) propellants. The primary explosives are generally very sensitive and serve to initiate a other less sensitive explosives. A secondary explosive has high brisance and shattering power but little propelling power. Most secondary explosives are usually less sensitive than primary explosives and require a primary explosive to initiate them. Pyrotechnics burns to produce visible smoke or provide light. Propellants, which are embodied in this invention, are designed to produce a large quantity of gas quickly to provide a propelling or driving force for shells or rockets.

The development of a useful propellant requires that many characteristics of the propellant be balance. Some critical characteristics of a propellant are density, stability, and combustion efficiency. High density is usually desirable for a propellant because systems in which a propellant is used are generally limited in volume. A greater weight of a high density propellant is, therefore, preferred for use in a volume-limited system. A comparison of the thrust per pound of different propellants considered in relation to the volume and density of each gives an indication of the performance of the propellant. Also, the propellant must burn substantially completely in order to make best use of the propellant. For example, standard high-energy propellants contain aluminum which must completely oxidize for highest energy production. However, the aluminum in a propellant rarely provides close to 100% of the available energy due to its failure to undergo complete oxidation the aluminum.

Lead or lead compounds are a possible solution to the density problems. However, lead compounds and lead create other problems because of incompatibility with other propellant components. Thus, use of lead containing materials to provide high density fuels for propellants is not known at this time to be feasible.

Stability is another critical characteristic of a propellant. A propellant, for military purposes, must maintain its thrust, power, and physical characteristics over a temperature range of −65° F. to 165° F. (approximately −54° C. to 74° C.). Double base and composite modified double base propellants have an additional stability problem. These propellants are susceptible to the formation of internal gases with aging. The gases thus formed cause cracking of the propellant and destruction of the physical properties of the propellant.

SUMMARY OF THE INVENTION

Therefore, it is an object of this invention to provide a composition suitable for use as a propellant having high density.

Also, an object of this invention is to provide a composition suitable for use as a propellant having high combustion efficiency.

It is a further object of this invention to provide a composition suitable for use as a propellant having high stability.

It is a still further object of this invention to provide a composition suitable for use as a propellant having reduced gassing tendencies.

Another object of this invention is to provide a lead compound suitable for use in a propellant.

These and other objects of the invention are met by incorporating in the propellant at least one lead fluoride selected from the group consisting of $PbF_2$ and $PbF_4$.

DESCRIPTION OF THE PREFERRED EMBODIMENTS

A propellant having at least one lead fluoride selected from the group consisting of $PbF_2$ and $PbF_4$ incorporated therein has stability, high combustion efficiency, and high density.

Lead fluoride, which can be produced by any standard process such as the process disclosed in U.S. Pat. No. 2,972,515 to Mockrin, incorporated herein by reference, produces a number of advantages when incorporated in a propellant. Efficiency of combustion is improved substantially and the improvement is directly proportional to the amount of lead fluoride used in the propellant. Lead fluoride also increases the density-impulse product and increases the delivered impulse per unit volume. A lead fluoride-containing propellant also shows improved results by reducing the gassing of the stored propellant. About 5% to 45% lead fluoride by weight of the propellant is suitable for use without a substantial sacrifice in the other properties of a propellant. About 10% to 34% lead fluoride requires less sacrifice of other propellant qualities. About 17% to 26% of the lead fluoride is preferred.

Lead fluoride acts in a propellant to increase density, and combustion efficiency, as well as to increase the desired stability. It is possible to formulate a propellant on paper and test that propellant by computer. In the test by computer, certain values are calculated and compared with the desired result. If the calculated results are promising, the propellant is formulated. Then an actual test is run. Usually a particular additive has an actual value lower than its calculated value. The results of this invention show actual values substantially in excess of 90% of the calculated value.

Lead fluoride is suitable for use in any amount with a propellant. The above cited ranges are believed, however, to be the most useful. With a double base propellant or a composite modified double base propellant, lead fluoride reduces the internal gassing which causes the cracking of the propellant. When aluminum is a component of the propellant, lead fluoride assists the complete combustion of the aluminum in the propellant. Lead fluoride is compatible with propellants whereas other lead compounds are neither compatible with nor provide stability in the propellant.

The only sacrifice in a propellant caused by using lead fluoride is that the specific impulse (available energy per unit weight of propellant) is somewhat reduced. This is offset by the increased density, thus giving high values of volumetric impulse (available energy per unit volume) as evidenced by the product of specific impulse and density.

The following examples are intended to illustrate without unduly limiting the invention. All parts and percentages are by weight unless otherwise specified.

EXAMPLE I

A propellant having the following formulation is prepared in a standard fashion:

12.170% metriol trinitrate;
2.000% triethylene glycol dinitrate;
0.700% ethyl centralite;
0.300% resourcinol;
8.000% nitrocellulose(as plastisol nitrocellulose of U.S. Pat. No. 3,671,515 to Cox et al with 12.6% N by weight of nitrocellulse);
32.830% ammonium perchlorate;
18.000% aluminum;
26.000% lead fluoride.

The ballistic parameters of the propellant are calculated and reported in Tables I, II, and III. Table I shows the composition of the formulation, the heat of formation and density of the components which are computer analyzed by free energy miniminization for burning at 1,000 pounds per square inch pressure absolute(psia) (351.9 kilograms per square centimeter (K/$_{cm}$2)) with the propellant gases exhausting to 14.7 psia(5.0 K/cm$_2$).

Table II shows the properties and composition of the propellant gases in the combustion chamber.

Table III shows the properties and composition of the exhaust gasses. It also predicts the theoretical specific impulse density and volumetric impulse (RHO-ISP).

TABLE I

COMPUTER CALCULATIONS

| INGREDIENTS | WEIGHT | CAL/G | DENSITY | H | C | N |
|---|---|---|---|---|---|---|
| MTN | 12.170 | −406.00 | .05311 | 9.00000 | 5.00000 | 3.00000 |
| TEGDN | 2.000 | −636.55 | .04667 | 12.00000 | 6.00000 | 2.00000 |
| EC | .700 | −116.52 | .05600 | 20.00000 | 17.00000 | 2.00000 |
| RESORCINOL - RES | .300 | −777.01 | .04596 | 6.00000 | 6.00000 | |
| NITROCELLULOSE(12.6) | 8.000 | −624.84 | .05998 | 7.55000 | 6.00000 | 2.45000 |
| AP | 32.830 | −601.63 | .07045 | 4.00000 | | 1.00000 |
| ALUMINUM - AL | 18.000 | .00 | .09755 | | | |
| LEAD FLUORIDE | 26.000 | −646.38 | .29771 | | | |

| | N | O | F | AL | CL | PB |
|---|---|---|---|---|---|---|
| MTN | .00000 | 9.00000 | | | | |
| TEGDN | .00000 | 8.00000 | | | | |
| EC | .00000 | 1.00000 | | | | |
| RESORCINOL - RES | | 2.00000 | | | | |
| NITROCELLULOSE(12.6) | .45000 | 9.90000 | | | | |
| AP | .00000 | 4.00000 | | | 1.0000 | |
| ALUMINUM - AL | | | | 1.00000 | | |
| LEAD FLUORIDE | | | 2.00000 | | | 1.00000 |

GRAM ATOM AMOUNTS FOR PROPELLANT WEIGHT OF 100.000

| H | C | N | O | F | AL | CL | PB |
|---|---|---|---|---|---|---|---|
| 1.937098 | .525353 | .516328 | 1.912349 | .212063 | .667161 | .279411 | .106032 |

TABLE II

COMPUTER CALCULATIONS

| CHAMBER RESULTS | TEMP. (K.) | TEMP. (F.) | PRESS. (ATM) | PRESS. (PSI) |
|---|---|---|---|---|
| | 3866. | 6499. | 68.02 | 1000.0000 |
| ENTHALPY | | ENTROPY | MOLS GAS | |
| −48.08 | | 164.68 | 2.284 | |

| | | | |
|---|---|---|---|
| AL | .0014/ 1.42E-03 | ALCL | .0126/ 1.26E-02 |
| ALOCL | .0074/ 7.44E-03 | ALCL$_2$ | .0050/ 4.97E-03 |
| ALF | .0276/ 2.76E-02 | ALOF | .0245/ 2.45E-02 |
| ALH | .0001/ 1.47E-04 | ALHO$_2$ | .0000/ 1.42E-05 |
| C | .0000/ 5.01E-08 | CF$_2$ | .0000/ 1.36E-10 |
| CO$_2$ | .0488/ 4.00E-02 | C$_2$F$_2$ | .0000/ 3.25E-13 |
| C$_3$ | .0000/ 4.53E-16 | CL | .0422/ 4.22E-02 |
| CL$_2$ | .0001/ 5.61E-05 | F | .0011/ 1.07E-03 |
| H | .1427/ 1.43E-01 | NH | .0001/ 1.17E-04 |
| H$_2$O | .3326/ 3.33E-01 | NH$_3$ | .0000/ 1.18E-05 |
| N$_2$ | .2532/ 2.53E-01 | O | .0146/ 1.46E-02 |
| POCL$_4$ | .0000/ 5.07E-12 | PBF | .0004/ 3.95E-04 |
| PB | .0693/ 6.93E-02 | PB$_2$ | .0001/ 7.59E-05 |
| H$_2$O | .0000/ 1.00E-25 | ALNs | .0000/ 1.00E-25 |
| Cs | .0000/ 1.00E-25 | PBO* | .0000/ 1.00E-25 |
| ALCLF | .0111/ 1.11E-02 | ALCLF$_2$ | .0007/ 7.26E-04 |
| ALCL$_2$F | .0005/ 4.58E-04 | ALCL$_3$ | .0001/ 6.69E-05 |

TABLE II-continued

COMPUTER CALCULATIONS

| | | | |
|---|---|---|---|
| ALF$_2$ | .0067/ 6.67E-03 | ALF$_3$ | .0004/ 4.25E-04 |
| ALO | .0015/ 1.48E-03 | AL$_2$O | .0002/ 2.39E-04 |
| CH$_4$ | .0000/ 5.75E-09 | CO | .4765/ 4.77E-01 |
| C$_2$H | .0000/ 4.33E-10 | CNH | .0000/ 1.24E-05 |
| CLF | .0000/ 2.45E-06 | HCL | .1741/ 1.74E-01 |
| HF | .1308/ 1.31E-01 | F$_2$ | .0000/ 1.12E-09 |
| HO | .0712/ 7.12E-02 | H$_2$ | .3878/ 3.88E-01 |
| N | .0001/ 9.85E-05 | NO | .0096/ 2.01E-02 |
| O$_2$ | .0049/ 4.93E-03 | PBCL | .0201/ 2.01E-02 |
| PBF | .0000/ 1.32E-05 | PBO | .0161/ 1.61E-02 |
| PBF$_4$ | .0000/ 8.12E-45 | NHO | .0000/ 1.60E-05 |
| AL$_2$O$_3$s | .0000/ 1.00E-45 | Al$_2$O$_3$* | .2949/ 2.95E-01 |

TABLE III

COMPUTER CALCULATIONS

| EXHAUST RESULTS | TEMP. (K.) | TEMP. (F.) | PRESS. (ATM) | PRESS. (PSI) |
|---|---|---|---|---|
| | 2619. | 4255. | 1.00 | 14.70000 |
| ENTHALPY | | ENTROPY | MOLS GAS | |
| −107.06 | | 164.68 | 2.129 | |

| | | | |
|---|---|---|---|
| AL | .0000/ 4.47E-06 | ALCL | .0004/ 4.46E-04 |
| ALOCL | .0004/ 4.15E-04 | ALCL$_2$ | .0004/ 3.71E-04 |
| ALF | .0018/ 1.81E-03 | ALOF | .0036/ 3.62E-04 |
| ALH | .0000/ 1.66E-07 | ALHO$_2$ | .0000/ 1.68E-08 |
| C | .0000/ 8.94E-12 | CF$_2$ | .0000/ 7.18E-14 |
| CO$_2$ | .0590/ 5.90E-02 | C$_2$F$_2$ | .0000/ 5.55E-17 |
| C$_3$ | .0000/ 4.18E-22 | CL | .0163/ 1.63E-02 |
| CL$_2$ | .0000/ 5.99E-06 | F | .0001/ 5.88E-05 |
| H | .0301/ 3.81E-02 | NH | .0000/ 8.76E-07 |
| H$_2$O | .3232/ 3.23E-01 | NH$_3$ | .0000/ 4.50E-05 |
| N$_2$ | .2579/ 2.58E-01 | O | .0004/ 4.49E-04 |
| PBCL$_4$ | .0000/ 2.51E-14 | PBF | .0001/ 5.80E-05 |
| PB | .0831/ 8.31E-02 | PB$_2$ | .0000/ 6.29E-06 |
| H$_2$O* | .0000/ 1.00E-25 | ALNs | .0000/ 1.00E-25 |
| Cs | .0000/ 1.00E-25 | PBO* | .0000/ 1.00E-25 |
| ALCLF | .0010/ 1.03E-03 | ALCLF$_2$ | .0002/ 2.47E-04 |
| ALCL$_2$F | .0001/ 9.79E-03 | ALCL$_3$ | .0000/ 8.06E-06 |
| ALF$_2$ | .0000/ 7.70E-06 | ALF$_3$ | .0002/ 4.80E-04 |
| ALO | .0000/ 3.77E-06 | AL$_2$O | .0000/ 1.10E-07 |
| CH$_4$ | .0000/ 3.92E-11 | CO | .4664/ 4.66E-01 |
| C$_2$H$_2$ | .0000/ 1.95E-13 | CNH | .0000/ 2.01E-07 |
| CLF | .0000/ 4.61E-08 | HCL. | .2421/ 2.42E-01 |
| HF | .2027/ 2.03E-01 | F$_2$ | .0000/ 6.68E-13 |
| HO | .0074/ 7.54E-08 | H$_2$ | .4001/ 4.00E-01 |
| N | .0000/ 6.16E-17 | NO | .0004/ 4.18E-02 |
| O$_2$ | .0001/ 1.49E-14 | PBCL | .0180/ 4.80E-02 |
| PBF$_2$ | .0000/ 2.18E-06 | PBO | .0049/ 4.86E-03 |
| PBF$_4$ | .0000/ 1.28E-19 | NHO | .0000/ 8.57E-08 |

TABLE III-continued

| COMPUTER CALCULATIONS | | | |
|---|---|---|---|
| $AL_2O_2s$ | .0000/ 1.00E-25 | $Al_2O_3$* | .3921/ 3.29E-01 |
| HYPOTHESIS SHIFTING | IMPULSE (gm sec/gm) | THR. T (ATM) | THR. P (ATM) |
| | 226.6 | 3677. | 39.40 |
| PROPELLANT DENSITY OF .08606 (Spg. of 2.382) | | | |

EXAMPLE II

To test stability, the following propellant is formulated in a standard fashion by a slurry process:

14.165% metriol trinitrate;
2.000% triethylene glycol dinitrate;
1.000% ethyl centralite;
2.000% polyethylene glycol-toluene diisocyanate prepolymer;
8.000% nitrocellulose (as in Example 1);
5.000% ammonium perchlorate;
23.830% RDX
18.000% aluminum;
26.000% $PbF_2$;
0.005% dibutyltin dilaurate.

The slurry is cast in a standard fashion into 2 inch cubes and cured. These cubes are placed in an 80° C. surveillance oven and X-rayed every two or three days. After 54 days of tests no fissures or cracks are discovered by X-ray. Cutting of a sample confirms the absence of cracks or fissures. Control samples using no lead fluoride crack early in the test. (Time to crack of 2 to 7 days are common for the control). A time to crack of 30 days is considered to be excellent results.

EXAMPLE III

Propellants were formulated which were similar to the above compositions were cast into rocket motors.

The rocket motors were then tested for delivered impulse and reported in Table IV.

| Motor Weight (approx.) | | Volume % | Weight | % of theoretical |
|---|---|---|---|---|
| Kilograms | lbs | Solids Content | % $PbF_2$ | shifting impulse |
| 18.1 | 40 | 75 | 26 | 96.0 |
| 4.5 | 10 | 65 | 10 | 93.0 |
| 4.5 | 10 | 65 | 10 | 93.6 |
| 4.5 | 10 | 65 | 17 | 93.8 |
| 4.5 | 10 | 65 | 26 | 94.2 |
| 4.5 | 10 | 75 | 10 | 93.2 |
| 4.5 | 10 | 75 | 10 | 93.8 |
| 4.5 | 10 | 75 | 17 | 94.4 |
| 4.5 | 10 | 75 | 17 | 94.8 |
| 4.5 | 10 | 75 | 26 | 94.0 |
| 4.5 | 10 | 75 | 26 | 94.8 |
| 4.5 | 10 | 75 | 34 | 94.2 |
| 4.5 | 10 | 75 | 34 | 94.4 |
| 4.5 | 10 | 75 | 0 | 92.5 |
| 4.5 | 10 | 75 | 0 | 92.6 |

This example shows the effectiveness of the lead fluoride and the lack of detrimental effect on other propellant features.

Obviously numerous modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. In a propellant comprising a nitrocellulose-containing binder, and an oxidizer, the improvement comprising including as a component of the propellant at least one lead fluoride selected from a formula of the group consisting of $PbF_2$ and $PbF_4$.

2. The propellant of claim 1 wherein the lead fluoride comprises 5% to 45% by weight of the propellant.

3. The propellant of claim 2 wherein the lead fluoride comprises 10% to 34% by weight of the propellant.

4. In a propellant comprising a binder, and an oxidizer, the improvement comprising including as a component of the propellant at least one lead fluoride selected from a formula of the group consisting of $PbF_2$ and $PbF_4$, wherein the lead fluoride comprises 17% to 26% by weight of the propellant.

5. The propellant of claim 4 wherein the lead fluoride is $PbF_2$.

6. The propellant of claim 1 consisting of
12.170% metriol trinitrate
2.000% triethylene glycol dinitrate;
0.700% ethyl centralite;
0.300% resorcinol;
32.830: ammonium perchlorate;
18.000% aluminum;
26.000% $PbF_2$; and
8.000% plastisol nitrocellulose - all percentages being based on the weight of the propellant.

7. The propellant of claim 6 wherein the plastisol nitrocellulose contains 12.6% nitrogen by weight of the nitrocellulose.

8. The propellant of claim 1 consisting of
14.165% metriol trinitrate:
2.000% triethylene glycol dinitrate;
1.000% ethyl centralite;
2.000% polyethyleneglycol-toluene diisocyanate prepolymer;
8.000% plastisol nitrocellulose;
5.000% ammonium perchlorate;
23.830% cyclotrimethylenetrinitramine;
18.000% aluminum powder;
26.000% $PbF_2$; and
0.005% dibutyl tin dilaurate; all percentages being based on weight.

9. The propellant of claim 8 wherein the plastisol nitrocellulose contains 12.6% nitrogen by weight of nitrocellulose.

10. In a propellant composition selected from the group consisting of double base propellants and composite modified double base propellants wherein the improvement comprises the addition to the propellant composition of a lead salt selected from the group consisting of $PbF_2$ and $PbF_4$ and mixtures thereof, wherein the lead salt is present in an amount between 5 and 45% by weight based on the total weight of the propellant composition.

11. The propellant composition of claim 10 wherein the lead salt is present in an amount between 17 and 26% by weight based on the total weight of the propellant composition.

12. An improved composite modified double base propellant composition wherein the improvement comprises the addition to the propellant composition of a lead salt selected from the group consisting of $PbF_2$ and $PbF_4$ and mixtures thereof, wherein the lead salt is present in an amount between 5 and 45% by weight based on the total weight of the propellant composition.

13. The propellant composition of claim 12 wherein the lead salt is present in an amount between 17 and 26% by weight based on the total weight of the propellant composition.

* * * * *